United States Patent [19]

Muller

[11] Patent Number: 4,819,936

[45] Date of Patent: Apr. 11, 1989

[54] BACK AND LEG STRETCHER

[76] Inventor: Donald Muller, 65 Tam O'Shanter Dr., Mahwah, N.J. 07430

[21] Appl. No.: 152,468

[22] Filed: Feb. 5, 1988

[51] Int. Cl.[4] ..... A63B 21/00

[52] U.S. Cl. ..... 272/126; 272/903

[58] Field of Search ..... 272/120, 121, 126, 134, 272/144, 116, 903, 93; 128/25 R, 70, 75

[56] References Cited

U.S. PATENT DOCUMENTS

| | | | |
|---|---|---|---|
| 1,537,464 | 5/1975 | Hummel, Jr. | 128/25 R |
| 1,641,188 | 9/1927 | Mittag | 272/134 |
| 4,079,933 | 3/1978 | Everroad | 272/126 |
| 4,248,420 | 2/1981 | Hayes | 272/126 |
| 4,445,684 | 5/1984 | Ruff | 272/134 |
| 4,565,368 | 1/1986 | Boettcher | 272/116 |

*Primary Examiner*—Richard J. Apley
*Assistant Examiner*—J. Welsh
*Attorney, Agent, or Firm*—W. Patrick Quast

[57] ABSTRACT

A back and leg stretcher, for applying a pusher force on an operator thereof, while supporting the operator in a seat assembly, is provided. The stretcher has a seat assembly and a pusher assembly. The seat assembly has a horizontal seat unit, a lower frame with two legs, and an upper frame with two legs. The pusher assembly has a pivot assembly, a pivot beam, a pusher unit, and a pulley system. The pivot assembly is centrally supported on the upper end of the horizontally seat unit. The pivot beam has a counterweight at a first end thereof and has a first pivot bolt at its midlength portion. The pusher unit has a pair of pusher arms pivotally supported by a second pivot bolt at one end and has a back engaging portion at its other end. The pulley system has a pulley rope, held by the operator at one end and extending through a pulley at its midlength portion and applying a force and torque on the pivot beam at its other end.

4 Claims, 1 Drawing Sheet

BACK AND LEG STRETCHER

The invention relates to a back and leg stretcher, and in particular the invention relates to a back and leg stretcher having a seat assembly and a pusher assembly.

BACKGROUND OF THE INVENTION

The prior art back and leg stretcher is shown in U.S. Pat. No. 4,588,186 issued May 13, 1986. Related patents include U.S. Pat. No. 1,641,188 issued Sept. 6, 1927 and U.S. Pat. No. 3,164,150, issued Jan. 5, 1965, and U.S. Pat. No. 3,984,101, issued Oct. 5, 1976, and U.S. Pat. No. 4,456,249, issued June 26, 1984, and U.S. Pat. No. 4,519,605, issued May 28, 1985, and U.S. Pat. No. 4,666,152, issued May 19, 1987, and PCT Patent No. WO 81/00967.

The prior art back and leg stretcher includes a puller assembly which has a shoulder harness, a first ring connected to the harness, two ropes, each rope being fixed to the first ring at one end thereof, a foot strap, a second ring connected to the foot strap, each rope having a midsection running through the second ring, whereby the operator can pull the ropes thereby applying a pulling force on the operator.

One problem with the prior art back and leg stretcher is that the foot strap applies a relatively large force on the feet during operation thereof, which is objectionable to a person having a foot injury. Another problem is that a pulling force applied to a person having a certain type of back injury is undesirable.

SUMMARY OF THE INVENTION

According to the present invention, a back and leg stretcher is provided. This back and leg stretcher comprises a seat assembly for supporting the operator and a pusher assembly for applying a pushing force to the back of the operator.

By using the structure of the seat assembly and the pusher assembly, the force applied to the feet of the operator is minimized and the pulling force on the operator is eliminated.

BRIEF DESCRIPTION OF THE DRAWINGS

The above advantages and the subsequent description will be more readily understood by reference to the following drawings.

DESCRIPTION OF THE PREFERRED EMBODIMENTS

Figure 1:
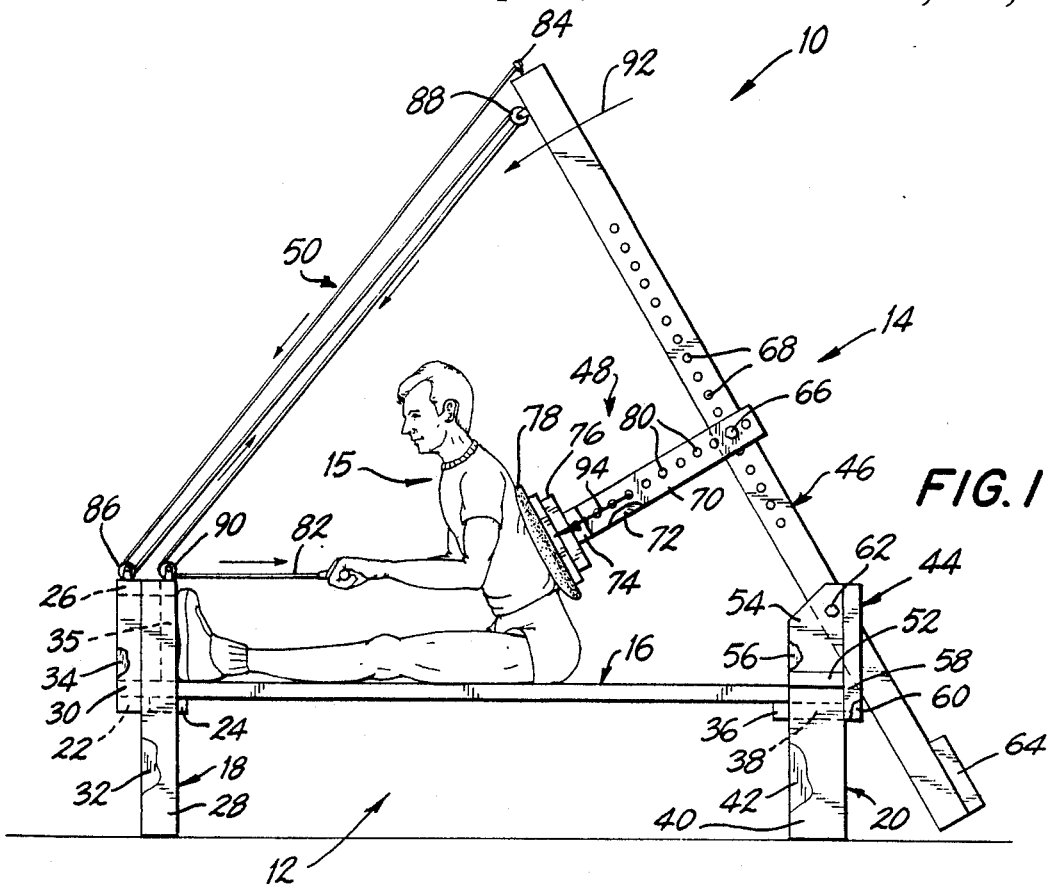
FIG. 1 is an elevation view of a back and leg stretcher according to the invention.

In FIG. 1, a back and leg stretcher 10 according to the invention is shown. Stretcher 10 includes a seat assembly 12 and a pusher assembly 14 for an operator 15. Seat assembly 12 includes a horizontal unit 16, a lower frame 18, and an upper frame 20. Lower frame 18 has two adjacent transverse members 22, 24, and one other transverse member 26. Lower frame 18 also has a lower left post 28 which has an upright member 30, a lower right post 32, which has an upright member 34, and a foot rest member 35. Upper frame 20 has two transverse members 36, 38 an upper left leg 40, and an upper right leg 42.

In FIG. 1, pusher assembly 14 includes a pivot assembly 44, a pivot beam 46, a pusher unit 48, and a pulley system 50. Pivot assembly 44 includes a base member 52 which is mounted on horizontal unit 16 at the central portion thereof, two upright members 54, 56 which are mounted on base member 52, two brace members 58, 60, and a first pivot bolt 62 which extends through upright members 54, 56.

In FIG. 1, beam 46, which is supported by first bolt 62 and which pivots about bolt 62, has a counterweight 64 at the lower end thereof. Beam 46 has a second pivot bolt 66, and has a plurality of adjusting holes 68 for bolt 66. Pusher unit 48, which is supported by a second bolt 66 and which pivots about bolt 66, includes two pusher arms 70, 72, a transverse member 74, and a back engaging member 76 which has a padded portion 78. Pusher arms 70, 72 have a plurality of adjusting holes 80 for bolt 66.

In FIG. 1, pulley system 50 includes a pull rope 82, which is pulled by operator 15. Rope 82 extends from and is fixedly connected to an eye screw 84 which is connected to beam 46 at the upper end thereof. Rope 82 extends from screw 84, then through a pulley 86 which is mounted on member 26, then through a pulley 88 which is fixed to beam 46, and then through a pulley 90 which is mounted on member 26.

In operation, operator 15 pulls rope 82, and thereby applies a pulley force 92 to beam 46 at the upper end thereof, which causes a counter-clockwise torque on beam 46 about bolt 62, that causes a pusher force 94 by member 76 against the back of operator 15, thereby stretching the back and legs of operator 15.

Figure 2:
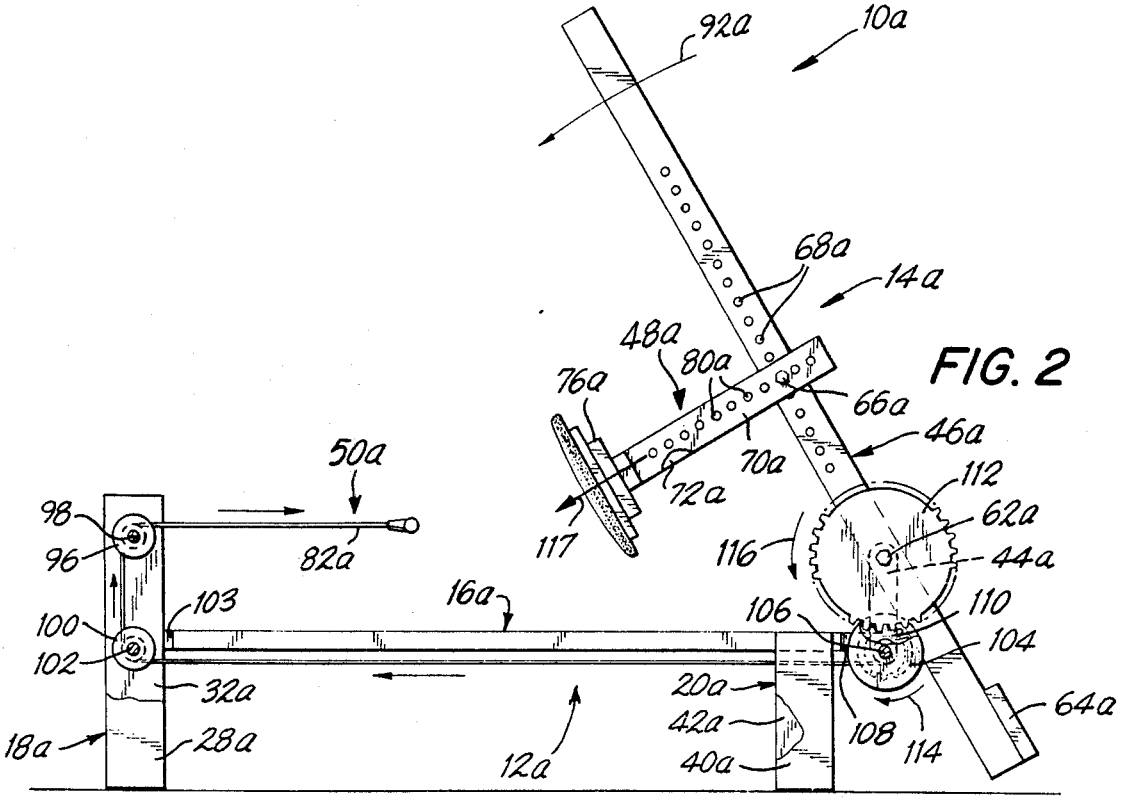
FIG. 2 is an elevation view of a second embodiment of a back and leg stretcher according to the invention.

In FIG. 2, an elevation view of an alternate embodiment of a back and leg stretcher 10*a* is shown. Parts of FIG. 2, which are the same as corresponding parts of FIG. 1, have the same numerals, but with a subscript "a" added thereto.

In FIG. 2, stretcher 10*a* includes a seat assembly 12*a*, a pusher assembly 14*a* for an operator (not shown). Seat assembly 12*a* includes a horizontal unit 16*a*, a lower frame 18*a* and an upper frame 20*a*. Lower frame 18*a* has a lower left post 28*a* and a lower right post 32*a*. Upper frame 20*a* has an upper left leg 40*a* and an upper right leg 42*a*.

Pusher assembly 14*a* includes a pivot assembly 44*a*, a beam 46*a*, a pusher unit 48*a*, and a pulley system 50*a*. Pivot assembly 44*a* has a pivot bolt 62*a*. Beam 46*a* has a counterweight 64*a*. Beam 46*a* also has a second pivot bolt 66*a* with a plurality of adjusting holes 68*a*. Pusher unit 48*a* has two pusher arms 70*a*, 72*a*, a back engaging member 76*a*, and a plurality of adjusting holes 80*a* for bolt 66*a*.

Pulley system 50*a* includes a pull rope 82*a*, and a first spool 96, which has an axle 98, that is mounted on legs 28*a*, 32*a*. pulley system 50*a* also has a second spool 100, which has an axle 102 that is mounted on legs 28*a*, 32*a*. Spools 98, 100 are located approximately midway between legs 28*a* and 32*a* and are positioned on respective axles 98, 102 by washers (not shown). Seat beam 16*a* has a notched portion 103 for pulley 100. Pulley system 50*a* has a third spool 104 which has an axle 106 that is mounted on pivot assembly 44*a*. Beam 16*a* has a notched portion 108 for spool 104. Legs 40*a*, 42*a* are positioned inwardly of pivot assembly 44*a* in a longitudinal direction.

Third spool 104 is next to beam 46*a* which is positioned approximately midway between legs 40*a*, 42*a*. Third spool 104 has a secondary gear 110, which is fixedly connected thereto. Beam 46*a* has a primary gear 112, which is fixedly connected thereto, and which meshes with secondary gear 110.

In operation, the operator pulls rope 82*a*, which applies a clockwise torque on spool 104 and secondary gear 110 that applies a counter-clockwise torque 116 on beam 46*a*, thereby urging back engaging member 76*a* toward the back of the operator, and applying a pusher force 117 against the back of the operator.

Although not shown, measuring means can be fixedly secured on the one end to transverse member 36 (or a transverse member, not shown, positioned parallel to member 36, between legs 40 and 42, but lower); and on the other end to pivot beam 46. The measuring means includes means to record the extent of a particular day's stretching. This enables the operator to check his daily progress.

Also not shown, but of assistance to the operator is the inclusion of a cleating device at a suitable location on horizontal unit 16. Similar or identical to a boat cleat, the operator can secure rope 82 to the cleat when he has achieved a desired stretch point. Thus, he can stay at this position for a desired period of time; or alight from the horizontal unit to set the progress recording means on the measuring means.

The back stretcher can be seen to offer support along the length of the back, including the lower back, as the operator performs his stretching exercises. Back arching is minimized, which, from a therapy point of view, is preferable.

While the invention has been described in its preferred embodiments, it is to be understood that the words which have been used are words of description, rather than limitation and that changes may be made within the purview of the appended claims without departing from the true scope and spirit of the invention in its broader aspects.

The embodiments of an invention in which an exclusive property or right is claimed are defined as follows:

1. A back and leg stretcher comprising:

a seat assembly for supporting an operator;

wherein the seat assembly includes a horizontal seat unit, a lower frame for supporting a lower end of the horizontal seat unit, and an upper frame for supporting an upper end of the horizontal seat unit, wherein the lower frame has a left leg and a right leg and wherein the upper frame has a left leg and a right leg, and, a pusher assembly for applying a pusher force on an operator, wherein said pusher assembly includes a pivot assembly supported by the seat assembly, a pivot beam pivotally connected to the pivot assembly, a pusher unit pivotally connected to the pivot beam, and a pulley system for pivoting the pivot beam and pusher unit, wherein said pivot assembly has a pair of upright members disposed on each side of the pivot beam, and has a pivot bolt extending through the pair of upright members and through the pivot beam, and wherein the pivot beam has counterweight means at a lower end thereof, and wherein the pusher unit includes at least one pusher arm pivotally connected at one end to said pivot beam and a back engaging member at the other end for applying a pusher force on the operator.

2. The stretcher of claim 1, wherein the pulley system includes a pulley rope having a first end for pulling by an operator and having a second end for applying a torque on the pivot beam thereby applying the pusher force on the operator.

3. The stretcher of claim 2, wherein the pulley system has at least one pulley mounted on the seat assembly at a lower end thereof for passing a midlength portion of the pulley rope there through

4. The stretcher of claim 2, wherein the pulley system includes a primary gear fixedly connected to the pivot beam and includes a secondary gear in mesh with the primary gear and rotatably mounted on the seat assembly and having an integral spool portion fixedly connected to the second end of the pulley rope.

* * * * *